US010584932B2

(12) United States Patent
Foster

(10) Patent No.: US 10,584,932 B2
(45) **Date of Patent: *Mar. 10, 2020**

(54) TRIGGER-LOCKING APPARATUS, SYSTEM, AND METHOD FOR SEMIAUTOMATIC FIREARMS

(71) Applicant: David Foster, Seymour, IN (US)

(72) Inventor: David Foster, Seymour, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/278,985

(22) Filed: Feb. 19, 2019

(65) Prior Publication Data

US 2019/0186858 A1 Jun. 20, 2019

Related U.S. Application Data

(63) Continuation-in-part of application No. 15/466,023, filed on Mar. 22, 2017, now Pat. No. 10,267,585, (Continued)

(51) Int. Cl.
*F41A 17/46* (2006.01)
*F41A 19/24* (2006.01)
(Continued)

(52) U.S. Cl.
CPC ..... *F41A 19/24* (2013.01); *F41A 17/46* (2013.01); *F41A 17/48* (2013.01); *F41A 19/10* (2013.01)

(58) Field of Classification Search
CPC ..... F41A 19/10; F41A 19/24; F41A 19/25; F41A 19/26; F41A 19/29; F41A 19/30; F41A 19/31; F41A 19/33; F41A 19/06; F41A 17/48; F41A 17/68; F41A 17/46; F41A 17/32; F41A 17/42; F41A 17/74; F41A 17/76; F41A 19/02; F41A 19/27; F41A 19/45
See application file for complete search history.

(56) References Cited

U.S. PATENT DOCUMENTS 2,039,814 A * 5/1936 Loomis ..... F41A 17/48 42/20
2,869,269 A * 1/1959 Couture ..... F41A 17/32 42/70.06

(Continued)

*Primary Examiner* — Michael D David
(74) *Attorney, Agent, or Firm* — Roberts IP Law; John Roberts

(57) ABSTRACT

Provided is an apparatus, system, and method for improved control of trigger systems for semiautomatic firearms, which may include a timed locking mechanism incorporated in the trigger system that locks the trigger in the rearward or pulled position after the trigger is pulled and the action of the firearm is cycling or otherwise out-of-battery. Such a mechanism ensures that the necessary steps occur in the proper sequence in the trigger mechanism, preventing unexpected fires, misfires, and jams. Such trigger locking mechanisms have applicability to dual-mode trigger systems as well as semiautomatic firearms generally, and tend to prevent the ability to bump-fire the firearm. Such trigger locking mechanisms may also provide a tactile signal through the user's trigger finger indicating that the firearm is empty by locking the trigger in the rearward position after the firearm fires its last round and the carrier moves and remains in a rearward position.

20 Claims, 3 Drawing Sheets

Related U.S. Application Data which is a continuation-in-part of application No. 15/419,460, filed on Jan. 30, 2017, now Pat. No. 10,254,067.

(60) Provisional application No. 62/632,014, filed on Feb. 19, 2018, provisional application No. 62/794,672, filed on Jan. 20, 2019, provisional application No. 62/311,807, filed on Mar. 22, 2016, provisional application No. 62/288,385, filed on Jan. 28, 2016.

(51) Int. Cl.
*F41A 19/10* (2006.01)
*F41A 17/48* (2006.01)

(56) References Cited

U.S. PATENT DOCUMENTS 3,196,747 A * 7/1965 Gallagher ..... F41A 19/31 89/145
3,292,492 A * 12/1966 Sturtevant ..... F41A 19/02 89/128
3,553,877 A * 1/1971 Welch et al. ..... F41A 17/02 42/70.01
3,845,688 A * 11/1974 Seecamp ..... F41A 19/45 89/146
3,924,599 A * 12/1975 Hammond ..... F41A 17/48 124/67
4,004,496 A * 1/1977 Snodgrass ..... F41A 19/02 89/129.02
4,023,465 A 5/1977 Inskip
4,308,786 A 1/1982 Hayashi
4,499,684 A * 2/1985 Repa ..... F41A 19/17 42/69.01
4,555,861 A * 12/1985 Khoury ..... F41A 17/72 42/69.01
4,697,495 A * 10/1987 Beretta ..... F41A 19/15 89/143
5,216,190 A * 6/1993 Tanaka ..... F41A 17/48 42/69.02
5,718,074 A * 2/1998 Keeney ..... F41A 19/45 42/69.01
7,398,723 B1 * 7/2008 Blakley ..... F41A 19/12 42/69.01
7,562,614 B2 * 7/2009 Polston ..... F41A 19/33 42/69.03
8,667,881 B1 * 3/2014 Hawbaker ..... F41A 19/46 42/69.01
8,820,211 B1 9/2014 Hawbaker
9,970,724 B1 * 5/2018 Acker ..... F41A 17/46
2009/0044438 A1 2/2009 Yollu
2011/0167697 A1 7/2011 Geissele
2012/0144712 A1 6/2012 Rostocil
2014/0259845 A1 * 9/2014 Johnson ..... F41A 19/09 42/69.01
2018/0087860 A1 * 3/2018 Sullivan ..... F41A 17/46

* cited by examiner

TRIGGER-LOCKING APPARATUS, SYSTEM, AND METHOD FOR SEMIAUTOMATIC FIREARMS

CROSS-REFERENCE TO RELATED APPLICATIONS

This application claims priority to, incorporates herein by reference, and is a non-provisional of U.S. provisional patent application No. 62/632,014 to David Foster, filed Feb. 19, 2018 and entitled Systems, Methods, and Kits for Preventing Bump Fire (herein "the '014 Application"). This application also claims priority to, incorporates herein by reference, and is a non-provisional of U.S. provisional patent application No. 62/794,672 to David Foster, filed Jan. 20, 2019 and entitled AK Backup Disconnect Application AND Timing Lever—Trigger Lock Additional Embodiments AND Assisted Trigger Reset Application (herein "the '672 Application"). This application further claims priority to, incorporates herein by reference, and is a continuation-in-part of co-pending U.S. regular utility patent application Ser. No. 15/466,023 to David Foster, filed Mar. 22, 2017 and entitled Trigger Having a Movable Sear and Firearms Incorporating Same (herein "the '023 Application"). This application additionally claims priority to, incorporates herein by reference, and is a continuation-in-part of co-pending U.S. regular utility patent application Ser. No. 15/419,460 to David Foster, filed Jan. 30, 2017 and entitled Trigger-Locking Apparatus, System, and Method for Semiautomatic Firearms (herein "the '460 Application"). This application still further claims priority to and incorporates herein by reference the U.S. provisional patent applications to which the '023 Application and the '460 Application claim priority and incorporate by reference, namely U.S. provisional patent application No. 62/311,807 to David Foster, filed Mar. 22, 2016 and entitled Trigger Having a Moveable Sear and Firearms Incorporating Same (herein "the '807 Application"), and U.S. provisional patent application No. 62/288,385 to David Foster, filed Jan. 28, 2016 and entitled Timing Apparatus, System, and Method for Dual Mode Trigger for Semiautomatic Firearms (herein "the '385 Application").

FEDERALLY SPONSORED RESEARCH OR DEVELOPMENT

None.

TECHNICAL FIELD

The present invention relates generally to firearms, and more particularly to improvements to trigger systems for semiautomatic firearms.

BACKGROUND

Selectable dual mode triggers for semiautomatic firearms are known, which include triggers capable of actuating and firing rounds on both pull and release of the trigger. Examples of such systems are disclosed in U.S. Pat. No. 8,667,881 B1 to Hawbaker, granted 2014 Mar. 11 (herein "the '881 patent"), and U.S. Pat. No. 8,820,211 B1 to Hawbaker, granted 2014 Sep. 2 (herein "the '211 patent") (collectively "the Hawbaker patents"), both of which are incorporated herein by reference. The characteristics of selecting modes of actuation in which only one round is discharged with one function of the trigger was approved by the ATF and granted the patents mentioned above and incorporated herein.

The introduction of a trigger that actuates on both pull and release presents several challenges. For example, during the testing of this new trigger, misfires were sometimes experienced due to light primer strikes, unexpected trigger states during actuation, and magazine changes. It quickly became apparent that improvements were needed to address these and related issues. In working to solve these problems, innovations were discovered that have applicability to not only pull-and-release triggers, but also to semiautomatic firearms generally.

SUMMARY

One of these innovations is a trigger-locking apparatus, system, and method for semiautomatic firearms, wherein the trigger, when pulled back and causing the firearm to fire, is locked in the pulled-back position until the action of the firearm cycles and returns to an in-battery state. Not only does this type of trigger locking system tend to address the trigger-control issues discussed in the applications incorporated herein, this type of trigger locking system also tends to prevent bump-firing, which is explained in detail in the incorporated '014 Application. Further, since the present system locks the trigger in the rearward position when the action is rearward (out of battery), this provides an additional benefit of providing a tactile signal to the user when the firearm becomes empty. More specifically, the action of a semiautomatic firearm typically moves and stays rearward (out of battery) after the firearm fires the last round in its magazine. This typical functionality of semiautomatic firearms causes the present trigger to remain locked in the rearward position after the firearm fires the last round in its magazine, thereby providing a tactile signal through the user's trigger finger indicating that the firearm is empty (without having to look down at the firearm). Not having to look down at the firearm to determine whether it is out of ammunition provides an important benefit to users in military and other tactical environments who may need to maintain their visual attention continuously focused elsewhere.

For example, provided in various example embodiments is a trigger-locking apparatus for a semi-automatic firearm having a trigger and an action that cycles by a carrier assembly element translating longitudinally and the action loading, firing, and extracting cartridges when the firearm is repeatedly fired by movements of the trigger, the trigger-locking apparatus comprising: a structure that when in a first position allows movement of the trigger from a rearward pulled position to a forward released position, and when in a second position restricts movement of the trigger from a rearward pulled position to a forward released position; the trigger-locking apparatus configured so that, when it is installed in the semi-automatic firearm, the structure is configured to: be held in the first position by contact with the carrier assembly element when the action of the firearm is in an in-battery position ready to fire a first cartridge; be released from contact with the carrier assembly element and move to the second position when the trigger is pulled to the rearward pulled position and the firearm is firing the first cartridge and the action is being cycled; then be returned to the first position by contact with the carrier assembly element as the action of the firearm cycles back to the in-battery position ready to fire a second cartridge.

In various example embodiments the trigger-locking apparatus may be further configured so that, when it is installed in the semi-automatic firearm, the structure is configured to: be released from contact with the carrier assembly element and move to the second position when the trigger is pulled to the rearward pulled position and the firearm is firing the second cartridge and the action is being cycled; then be returned to the first position by contact with the carrier assembly element as the action of the firearm cycles back to the in-battery position ready to fire a third cartridge.

In various example embodiments the trigger-locking apparatus may be further configured so that, when it is installed in the semi-automatic firearm, the structure is configured to: be released from contact with the carrier assembly element and move to the second position when the trigger is pulled to the rearward pulled position and the firearm is firing a last cartridge and the action is being cycled; then remain released from contact with the carrier assembly element and remain in the second position holding the trigger in the rearward pulled position after the last cartridge is fired and the firearm does not cycle back to the in-battery position.

In various example embodiments the structure may be biased toward the second position by a spring. In various example embodiments the structure may be configured to move between the first and second positions by pivoting about an axis. In various example embodiments the structure may be configured to move between the first and second positions by translating linearly. In various example embodiments the carrier assembly element may comprise any of a carrier or a bolt that engages and moves the structure from the first position to the second position when the carrier assembly element translates longitudinally when the action is cycled. In various example embodiments the carrier assembly element may comprise a slide (such as that term is used in connection with semi-automatic handguns, for instance) that is configured to translate longitudinally when the action is cycled, and the structure is configured to be moved from the first position to the second position by longitudinal movement of the slide.

In various example embodiments the structure, when in a first position, allows movement of the trigger from a rearward pulled position to a forward released position, and when in a second position restricts movement of the trigger from a rearward pulled position to a forward released position, and is configured to restrict movement of the trigger from a rearward pulled position to a forward released position by engaging a downward facing surface on a rearward portion of a trigger assembly comprising the trigger.

In various example embodiments the structure, when in a first position, allows movement of the trigger from a rearward pulled position to a forward released position, and when in a second position restricts movement of the trigger from a rearward pulled position to a forward released position, and is configured to restrict movement of the trigger from a rearward pulled position to a forward released position by engaging an upward facing surface on a forward portion of a trigger assembly comprising the trigger. In various example embodiments the forward portion of the trigger assembly may comprise a hammer sear surface attached with the trigger.

Further provided in various example embodiments is a semi-automatic firearm having a trigger, a trigger-locking apparatus, and an action that cycles by a carrier assembly element translating longitudinally and the action loading, firing, and extracting cartridges when the firearm is repeatedly fired by movements of the trigger, wherein the trigger-locking apparatus comprises any combination of the components, features, and functionalities described above or otherwise herein.

Also provided in various example embodiments are methods of operating semi-automatic firearms as described herein, which include a trigger-locking apparatus comprising any combination of the components, features, and functionalities described above or otherwise herein. Such methods may include steps such as, for example, pulling the trigger a first time from the forward released position to the rearward pulled position and firing the first cartridge, thereby causing the action to cycle and the structure to move from the first position into the second position thereby causing the trigger-locking apparatus to lock the trigger in the rearward pulled position, and as the action of the firearm cycles back to the in-battery position ready to fire the second cartridge, causing the structure to move from the second position back to the first position thereby causing the trigger-locking apparatus to unlock the trigger and allowing the trigger to move back to the forward released position; pulling the trigger a second time from the forward released position to the rearward pulled position and firing the second cartridge, thereby causing the action to cycle and the structure to move from the first position into the second position thereby causing the trigger-locking apparatus to lock the trigger in the rearward pulled position, and as the action of the firearm cycles back to the in-battery position ready to fire a third and last cartridge, causing the structure to move from the second position back to the first position thereby causing the trigger-locking apparatus to unlock the trigger and allowing the trigger to move back to the forward released position; and pulling the trigger a third time from the forward released position to the rearward pulled position and firing the third and last cartridge, thereby causing the action to begin to cycle and the structure to move from the first position into the second position thereby causing the trigger-locking apparatus to: lock the trigger in the rearward pulled position; and remain released from contact with the carrier assembly element and remain in the second position holding the trigger in the rearward pulled position after the third and last cartridge is fired and the firearm does not cycle back to the in-battery position. Such methods may include a user firing all the rounds in the firearm and sensing with the user's finger, via the trigger that remains pulled back upon firing the last round, that the firearm is empty, all without looking at the firearm to determine its state.

Additional methods may also include attempting to bump-fire the firearm as described in the incorporated '014 Application, and the present trigger-locking apparatus preventing the firearm from rapidly repeatedly firing via such bump-fire techniques. Additional methods include installing the present trigger-locking apparatus into a firearm to prevent users of the firearm from bump-firing the firearm.

The foregoing summary is illustrative only and is not meant to be exhaustive or limiting. Other aspects, objects, and advantages of various example embodiments will be apparent to those of skill in the art upon reviewing the accompanying drawings, disclosure, and appended claims. These together with other objects of the invention, along with various features of novelty, which characterize the invention, are pointed out with particularity in the claims annexed hereto and forming a part of this disclosure. For a better understanding of the invention, its operating advantages and the specific objects attained by its uses, reference should be had to the accompanying drawings, claims and descriptive matter in which there is illustrated a preferred embodiment of the invention.

BRIEF DESCRIPTION OF THE DRAWINGS

Examples of the invention can be better understood with reference to the following figures. The components within the figures are not necessarily to scale, emphasis instead being placed on clearly illustrating example aspects of the invention. In the figures, like reference numerals designate corresponding parts throughout the different views. It will be understood that certain components and details may not appear in the figures to assist in more clearly describing the invention.

FIG. 1A shows the first example embodiment with a first example locking structure rotated to an unlocked position by a carrier assembly that is translated longitudinally forward when the action of the firearm is in an in-battery position ready to fire a cartridge.

FIG. 1B depicts the example embodiment of FIG. 1A with the trigger moving between non-firing and firing positions.

FIG. 1C shows the example embodiment of FIG. 1B with the trigger released yet locked in the rearward firing position by the locking structure, which is rotated to a locked position after it has been released from the unlocked position by movement of the carrier assembly longitudinally rearward in the direction of the arrows, as when the action of the firearm is being cycled during the firing of a cartridge.

FIG. 1D shows the example embodiment of FIG. 1C with the carrier assembly returning longitudinally forward in the direction of the arrows and re-contacting the locking structure as the action of the firearm continues to cycle after the firing of a cartridge.

FIG. 1E shows the embodiment of FIG. 1D with the carrier assembly having fully returned longitudinally forward in the direction of the arrows and re-rotating the locking structure to the unlocked position of FIG. 1A, allowing the trigger to move back to the forward position, when the action of the firearm is in an in-battery position ready to fire a second cartridge.

FIG. 2A shows the second example embodiment with a second example locking structure translated to an unlocked position by a carrier assembly that is translated longitudinally forward when the action of the firearm is in an in-battery position ready to fire a cartridge.

FIG. 2B depicts the example embodiment of FIG. 2A with the trigger moving between non-firing and firing positions.

FIG. 2C shows the example embodiment of FIG. 2B with the trigger released yet locked in the rearward firing position by the locking structure, which is translated to a locked position after it has been released from the unlocked position by movement of the carrier assembly longitudinally rearward in the direction of the arrows, as when the action of the firearm is being cycled during the firing of a cartridge.

FIG. 2D shows the example embodiment of FIG. 2C with the carrier assembly returning longitudinally forward in the direction of the arrows and re-contacting the locking structure as the action of the firearm continues to cycle after the firing of a cartridge.

FIG. 2E shows the embodiment of FIG. 2D with the carrier assembly having fully returned longitudinally forward in the direction of the arrows and re-translating the locking structure to the unlocked position of FIG. 2A, allowing the trigger to move back to the forward position, when the action of the firearm is in an in-battery position ready to fire a second cartridge.

FIG. 3A shows the third example embodiment with a third example locking structure rotated to an unlocked position by a carrier assembly that is translated longitudinally forward when the action of the firearm is in an in-battery position ready to fire a cartridge.

FIG. 3B depicts the example embodiment of FIG. 3A with the trigger moving between non-firing and firing positions.

FIG. 3C shows the example embodiment of FIG. 3B with the trigger released yet locked in the rearward firing position by the locking structure, which is rotated to a locked position after it has been released from the unlocked position by movement of the carrier assembly longitudinally rearward in the direction of the arrows, as when the action of the firearm is being cycled during the firing of a cartridge.

FIG. 3D shows the example embodiment of FIG. 3C with the carrier assembly returning longitudinally forward in the direction of the arrows and re-contacting the locking structure as the action of the firearm continues to cycle after the firing of a cartridge.

FIG. 3E shows the embodiment of FIG. 3D with the carrier assembly having fully returned longitudinally forward in the direction of the arrows and re-rotating the locking structure to the unlocked position of FIG. 3A, allowing the trigger to move back to the forward position, when the action of the firearm is in an in-battery position ready to fire a second cartridge.

Figure 1A:
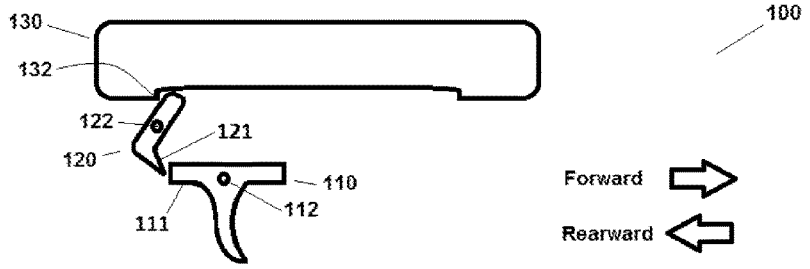
FIGS. 1A-1E illustrate a first example embodiment of a trigger-locking apparatus, system, and method for semiautomatic firearms that have an action that cycles by loading, firing, and extracting cartridges when the firearm is repeatedly fired by movements of the trigger, comprising a first example structure that when in an unlocked position shown in FIGS. 1A, 1B, 1E, allows movement of the trigger between non-firing and firing positions as shown in FIGS. 1A and 1B, and when in a rearward-locked position shown in FIGS. 1C and 1D, restricts movement of the trigger between firing and non-firing positions.

The invention is not limited to what is shown in these example figures. The figures, drawings, and photographs in the applications incorporated herein provide further example embodiments and alternatives. The invention is broader than the examples shown in any figures and covers anything that falls within any of the claims.

DETAILED DESCRIPTION OF EXAMPLE EMBODIMENTS

Reference will now be made in detail to some specific example embodiments, including any best mode contemplated by the inventor. Examples of these specific embodiments are illustrated in the accompanying drawings. While the invention is described in conjunction with these specific embodiments, it will be understood that it is not intended to limit the invention to the described or illustrated embodiments. On the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments may be implemented without some or all of these features or specific details. In other instances, components and procedures well known to persons of skill in the art have not been described in detail in order not to obscure inventive aspects.

Various techniques and mechanisms will sometimes be described in singular form for clarity. However, it should be noted that some embodiments may include multiple iterations of a technique or multiple components, mechanisms, and the like, unless noted otherwise. Similarly, various steps of the methods shown and described herein are not necessarily performed in the order indicated, or performed at all in certain embodiments. Accordingly, some implementations of the methods discussed herein may include more or fewer steps than those shown or described.

Further, the example techniques and mechanisms described herein will sometimes describe a connection, relationship or communication between two or more items or entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

To ensure clarity, an explanation of the term "in-battery" will now be provided. "In-battery" refers to the status of a firearm once the action has returned to the normal firing position. Out-of-battery refers to the status of a firearm before the action has returned to the normal firing position, and may include the status of semiautomatic firearm after it has fired its last round, when the action moves into and remains in a rearward position. According to the website Wikipedia, the term originates from artillery, referring to a gun that fires before it has been pulled back. In artillery guns, "out of battery" usually refers to a situation where the recoiling mass (breech and barrel) has not returned to its proper position after firing because of a failure in the recoil mechanism. Gun carriages should normally be designed to prevent this in typical circumstances. But if a gun is fired out of battery, then damage to the carriage can occur, as the effectiveness of the recoil mechanism will have been compromised. In firearms and artillery where there is an automatic loading mechanism, a condition can occur in which a live round is at least partially in the firing chamber and capable of being fired, but is not properly secured by the usual mechanism of that particular weapon (and thus is not "in battery"). The gas pressure produced at the moment of firing can rupture the not-fully-supported cartridge case and can result in flame and high-pressure gas being vented at the breech of the weapon, potentially creating flying shrapnel and possibly injuring the operator. Depending on the design, it is also possible for a semi-automatic firearm to simply not fire upon pulling the trigger when in an out-of-battery state. The present locking mechanisms 100, 200, 300 and the like are designed to lock the triggers (for instance but not by way of limitation, triggers 110, 210, 310) in the rearward or "pulled" position (which includes all the way rearward and substantially all the way rearward, allowing for normal play, clearances, and manufacturing variations), when the firearm is in an out-of-battery state. This tends to prevent the trigger control problems identified in the applications incorporated herein, tends to prevent bump-fire as explained in the '014 Application, and inherently provides a tactile signal to the user's trigger finger after the firearm has fired the last round in a magazine (since the trigger then remains in the rearward position, for instance as shown in FIGS. 1C, 2C, 3C).

Referring now to the drawings in detail to the drawings wherein like elements are indicated by like numerals, there are shown various aspects of example trigger-locking apparatus, system, and method for semiautomatic firearms. FIGS. 1A-1E illustrate a first example embodiment of certain portions of a trigger-locking apparatus, system, and method 100 for semiautomatic firearms. While not reproduced in the present figures for the sake of visual clarity, it is well known that semiautomatic firearms typically have a mechanism commonly known as an action that cycles by loading, firing, and extracting cartridges when the firearm is repeatedly fired by movements of the trigger. Here, the system 100 may comprise a trigger 110, which may pivot about an axis 112 between firing and non-firing positions (indicated by arrow 114), or may alternatively move laterally or may be actuated in any other suitable manner (not shown).

Figure 1B:
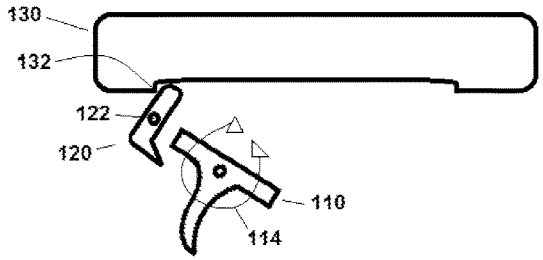
Figure 1C:
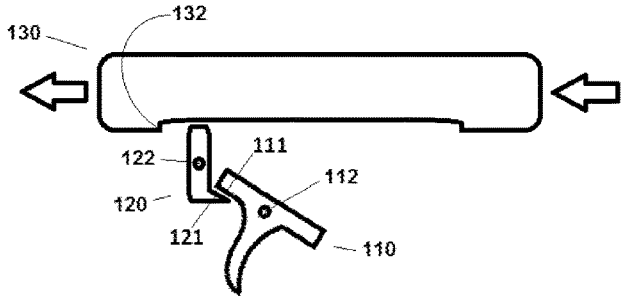
Figure 1D:
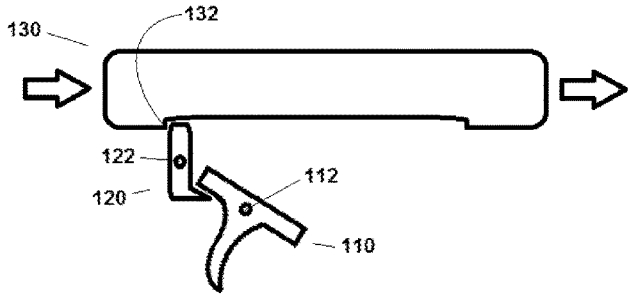
Figure 1E:
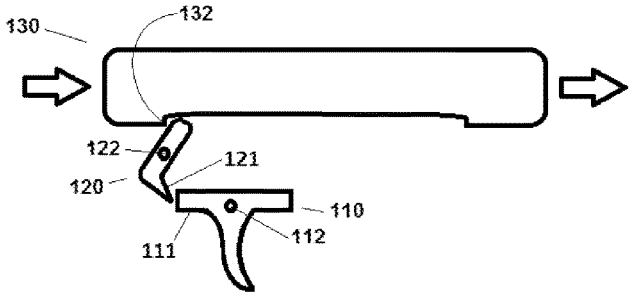

The system 100 may comprise a structure 120 that when in an unlocked position shown in FIGS. 1A, 1B, 1E, allows movement 114 of the trigger 110 between non-firing and firing positions as shown in FIGS. 1A and 1B. Turning to FIG. 1A, shown is a first example embodiment 100 with a first example locking structure 120 rotated about an axis 122 to an unlocked position by a carrier assembly 130 that is translated longitudinally forward (as indicated by the Forward arrow on the figures) when the action of the firearm is in an in-battery position ready to fire a cartridge (not shown). More specifically, in the example embodiment 100, an engagement feature 132 may be provided on or as part of carrier assembly 130 that when longitudinally translated forward and adjacent the structure 120, mechanically engages an upper portion of the structure 120 (that portion above the axis 122) and pushes it forward, thus causing the structure 120 to pivotally rotate about axis 122 in a clockwise direction as shown in FIGS. 1A and 1B, until the trigger 110 can rotate about its axis 112 sufficiently to fire a cartridge without the structure 120 interfering with the movement 114 of the trigger 110. This is the unlocked position.

The carrier assembly 130 may comprise any suitable components and features, such as a carrier, bolt assembly, bolt, and the like, as is known in the art of semi-automatic rifles, for instance. Alternatively, carrier assembly 130 may comprise a slide, for instance as is known in the art of semi-automatic pistols. Engagement feature 132 may comprise or be formed onto, into, or as part of any portion of the carrier assembly 130, and may comprise an abutment, a groove, or a convex or concave surface, or any other mechanical structure that will suitably function to mechanically engage the locking structure, such as locking structures 120, 220, 320, for example.

A spring or other biasing means (not shown) may be provided to rotationally urge the structure 120 in a counter-clockwise direction about the axis 122. For example and not by way of limitation, a torsional spring may be affixed against the structure 120 and around axis 122, or a helical compression spring may be provided pushing the upper portion of the structure 120 (that portion above the axis 122) in the rearward direction, or a helical compression spring may be provided pushing the lower portion of the structure 120 (that portion below the axis 122) in the forward direction, for example.

Once the trigger 110 is moved rearward by movement 114 from a non-firing position to a firing position and a cartridge is fired, the action of the firearm begins to cycle causing the carrier assembly 130 to move rearward as depicted in FIG. 1C. This moves the engagement feature 132 away from the locking structure 120, allowing the spring or other urging means discussed above but not shown to cause the locking structure 120 to automatically rotate counter-clockwise around axis 122, such that when the trigger 110 is released, an upward facing locking interface 121 on the locking structure 120 automatically engages a downward facing locking interface 111 on a rear portion of the trigger 110, and locks the trigger 110 in a rearward position as shown in FIGS. 1C and 1D, thereby restricting movement 114 of the trigger 110 between firing and non-firing positions while the action of the firearm is out-of-battery. This position and state as described with respect to FIG. 1C also includes the static state after a typical semiautomatic firearm has fired the last round of a magazine. As used herein, the term upward designates toward the top of the page and the term downward designates toward the bottom of the page, as a page is read from top to bottom. These terms upward, downward, forward, and rearward, are also generally understood to correspond to the same directions from the perspective of a user of a typical semiautomatic firearm while firing the firearm.

FIG. 1D shows the example embodiment 100 discussed above with respect to FIG. 1C with the carrier assembly 130 returning longitudinally forward in the direction of the arrows and the engagement feature 132 of the carrier assembly 130 re-contacting the locking structure 120 as the action of the firearm continues to cycle after the firing of a cartridge.

FIG. 1E shows the example embodiment 100 discussed above with respect to FIG. 1D with the carrier assembly 130 having fully returned longitudinally forward in the direction of the arrows when the action of the firearm is in an in-battery position ready to fire a second cartridge. The engagement feature 132 of the carrier assembly 130 has pushed forward the upper portion of the locking structure 120, causing the locking structure 120 to rotate clockwise against whatever spring forces may be urging the locking structure in the counter-clockwise direction, and the firearm and its components are in the same positions and states as they were at the beginning of the process as shown and described with respect to FIG. 1A, namely with the trigger 110 automatically unlocked and returned to its forward position (typically by operation of a trigger spring (not shown) generally urging the trigger forward at all times) once the action of the firearm returns to in-battery position. The trigger 110 is then free to move 114 as shown in FIG. 1B. This sequence can be repeated any number of times with any number of cartridges. After firing the last cartridge (also referred to herein as a round), the present trigger system in a typical semiautomatic rifle may remain in the state shown and described with respect to FIG. 1C. Also, since the trigger 110 is held in the rearward position (e.g., FIGS. 1C, 1D) at least substantially throughout the back-and-forth cycling of the action 130, this tends to reduce the ability of the firearm to be bump-fired by using the momentum of the firearm to repeatedly cycle the trigger 110 between firing and non-firing positions as described in the incorporated the '014 Application.

Figure 2A:
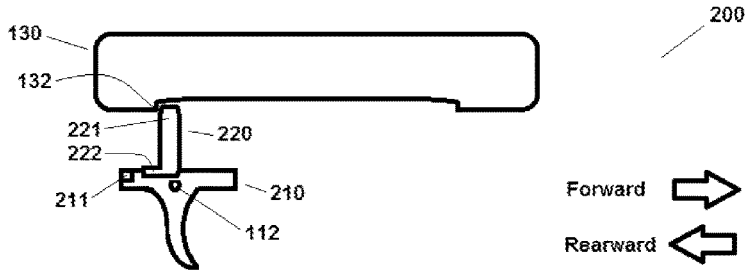
FIGS. 2A-2E illustrate a second example embodiment of a trigger-locking apparatus, system, and method for semiautomatic firearms that have an action that cycles by loading, firing, and extracting cartridges when the firearm is repeatedly fired by movements of the trigger, comprising a second example structure that when in an unlocked position shown in FIGS. 2A, 2B, 2E, allows movement of the trigger between non-firing and firing positions as shown in FIGS. 2A and 2B, and when in a rearward-locked position shown in FIGS. 2C and 2D, restricts movement of the trigger between firing and non-firing positions.
Figure 2B:
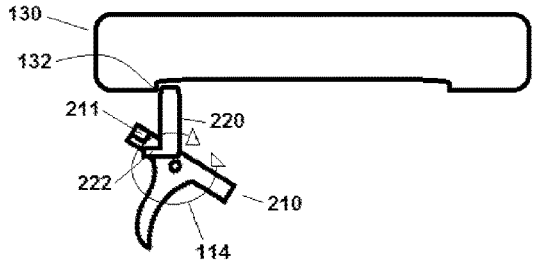
Figure 2C:
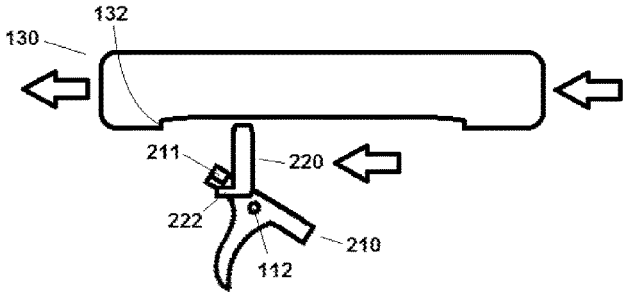
Figure 2D:
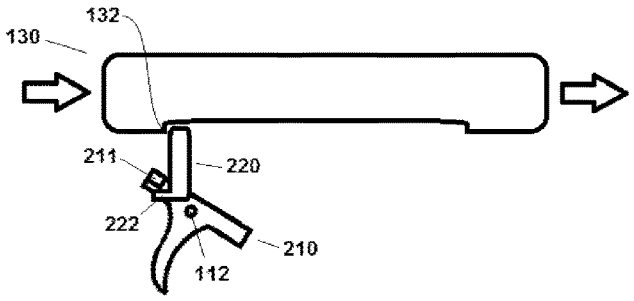
Figure 2E:
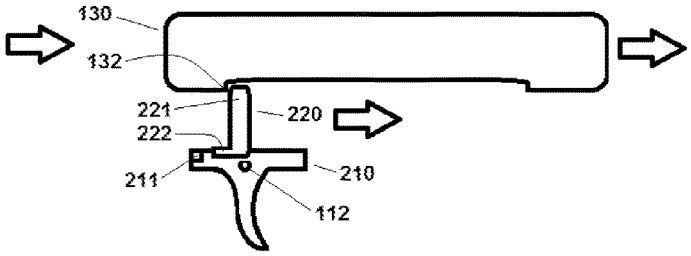

FIGS. 2A-2E illustrate a second example embodiment of a trigger-locking apparatus, system, and method 200 for semiautomatic firearms that have an action that cycles by loading, firing, and extracting cartridges when the firearm is repeatedly fired by movements of the trigger. System 200 may comprise a trigger 210, which may pivot about an axis 112 between firing and non-firing positions (indicated by arrow 114), or may alternatively move laterally or may be actuated in any other suitable manner (not shown). The system 200 may comprise a structure 220 that when in an unlocked position shown in FIGS. 2A, 2B, 2E, allows movement 114 of the trigger 210 between non-firing and firing positions as shown in FIGS. 2A, 2B, and 2E.

Turning to FIG. 2A, shown is a second example embodiment 200 with a second example locking structure 220 that translates linearly in a forward direction (as indicated by the Forward arrow on the figures), to an unlocked position by a carrier assembly 130 that is also translated longitudinally forward when the action of the firearm is in an in-battery position ready to fire a cartridge (not shown). More specifically, in the example embodiment 200, an engagement feature 132 may be provided on or as part of carrier assembly 130 that when longitudinally translated forward and adjacent the structure 220, mechanically engages an upper portion 221 of the structure 220 and pushes the whole structure 220 to a forward position as shown in FIGS. 2A, 2B, and 2E (for instance in a channel or other guiding structure, not shown), until the trigger 210 can rotate about its axis 112 sufficiently to fire a cartridge without the structure 220 interfering with the movement 114 of the trigger 210. This is the unlocked position.

The carrier assembly 130 may comprise any suitable components and features as described herein with respect to the first embodiment 100, and will suitably function to mechanically engage the locking structure 220 as described herein.

A spring or other biasing means (not shown) may be provided to urge the structure 220 in a rearward direction (as indicated by the Rearward arrow on the figures). For example and not by way of limitation, a helical compression spring may be provided pushing the structure 220 in the rearward direction, for example.

Once the trigger 210 is moved rearward by movement 114 from a non-firing position to a firing position and a cartridge is fired, the action of the firearm begins to cycle causing the carrier assembly 130 to move rearward as depicted in FIG. 2C. This moves the engagement feature 132 away from the locking structure 220, allowing the spring or other urging means discussed above but not shown to cause the locking structure 220 to automatically translate linearly in the rearward direction, such that when the trigger 210 is released, a lower portion 222 of the locking structure 220 automatically engages an engagement feature 211 of the trigger 210 and locks the trigger 210 in the rearward position as shown in FIGS. 2C and 2D, thereby restricting movement 114 of the trigger 210 between firing and non-firing positions while the action of the firearm is out-of-battery. This position and state as described with respect to FIG. 2C also includes the static state after a typical semiautomatic firearm has fired the last round of a magazine.

FIG. 2D shows the example embodiment 200 discussed above with respect to FIG. 2C with the carrier assembly 130 returning longitudinally forward in the direction of the arrows and the engagement feature 132 of the carrier assembly 130 re-contacting the locking structure 220 as the action of the firearm continues to cycle after the firing of a cartridge.

FIG. 2E shows the example embodiment 200 discussed above with respect to FIG. 2D with the carrier assembly 130 having fully returned longitudinally forward in the direction of the arrows when the action of the firearm is in an in-battery position ready to fire a second cartridge. The engagement feature 132 of the carrier assembly 130 has pushed forward the locking structure 220, causing the locking structure 220 to move linearly forwards against whatever spring forces may be urging the locking structure 220 in the rearward direction, releasing the trigger 210 to return to its (spring-urged) forward position, and the firearm and its components are in the same positions and states as they were at the beginning of the process as shown and described with respect to FIG. 2A, namely with the trigger 210 automatically unlocked and free to move 114 as shown in FIG. 2B once the action of the firearm returns to in-battery position. This sequence can be repeated any number of times with any number of cartridges. After firing the last cartridge or round, the present trigger system in a typical semiautomatic rifle may remain in the state shown and described with respect to FIG. 2C. Also, since the trigger 210 is held in the rearward position (e.g., FIGS. 2C, 2D) at least substantially throughout the back-and-forth cycling of the action 130, this tends to reduce the ability of the firearm to be bump-fired by using the momentum of the firearm to repeatedly cycle the trigger 210 between firing and non-firing positions as described in the incorporated the '014 Application.

FIGS. 3A-3E illustrate a third example embodiment of certain portions of a trigger-locking apparatus, system, and method for semiautomatic firearms, where the system 300 may comprise a trigger 310 which may pivot about an axis 112 between firing and non-firing positions (indicated by arrow 114), or may alternatively move laterally or may be actuated in any other suitable manner (not shown).

Figure 3A:
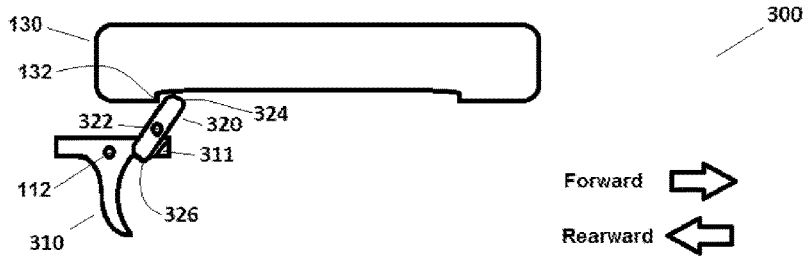
FIGS. 3A-3E illustrate a third example embodiment of a trigger-locking apparatus, system, and method for semiautomatic firearms that have an action that cycles by loading, firing, and extracting cartridges when the firearm is repeatedly fired by movements of the trigger, comprising a third example structure that when in an unlocked position shown in FIGS. 3A, 3B, 3E, allows movement of the trigger between non-firing and firing positions as shown in FIGS. 3A and 3B, and when in a rearward-locked position shown in FIGS. 3C and 3D, restricts movement of the trigger between firing and non-firing positions.
Figure 3B:
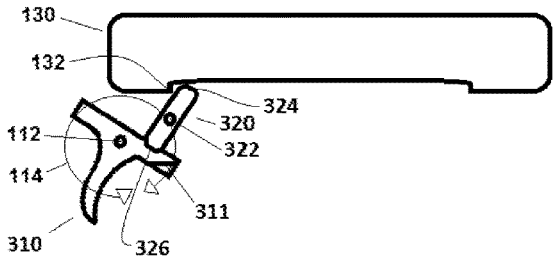
Figure 3C:
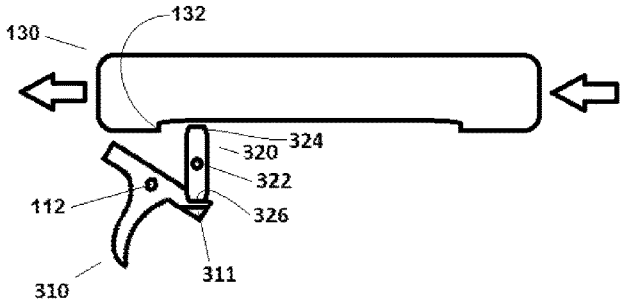
Figure 3D:
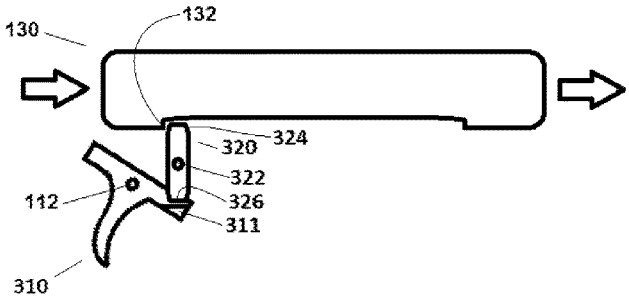
Figure 3E:
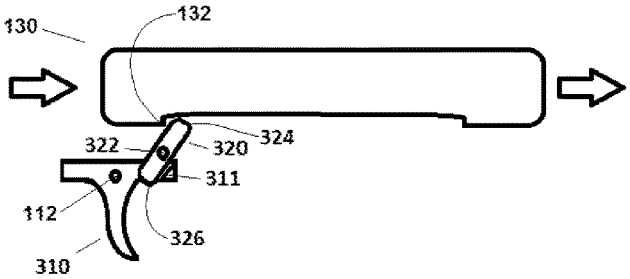

The system 300 may comprise a structure 320 that when in an unlocked position shown in FIGS. 3A, 3B, 3E, allows movement 314 of the trigger 310 between non-firing and firing positions as shown in FIGS. 3A, 3B, and 3E. Turning to FIG. 3A, shown is a third example embodiment 300 with a third example locking structure 320 rotated about an axis 322 to an unlocked position by a carrier assembly 130 that is translated longitudinally forward (as indicated by the Forward arrow on the figures) when the action of the firearm is in an in-battery position ready to fire a cartridge (not shown). More specifically, in the example embodiment 300, an engagement feature 132 may be provided on or as part of carrier assembly 130 that when longitudinally translated forward and adjacent the structure 320, mechanically engages an upper portion 324 of the structure 320 (that portion above the axis 322) and pushes it forward, thus causing the structure 320 to pivotally rotate about axis 322 in a clockwise direction as shown in FIGS. 3A, 3B, and 3E, until the trigger 310 can rotate about its axis 112 sufficiently to fire a cartridge without the structure 320 interfering with the movement 114 of the trigger 310. This is the unlocked position.

A spring or other biasing means (not shown) may be provided to rotationally urge the structure 320 in a counter-clockwise direction about the axis 322. For example and not by way of limitation, a torsional spring may be affixed against the structure 320 and around axis 322, or a helical compression spring may be provided pushing the upper portion of the structure 320 (that portion above the axis 322) in the rearward direction, or a helical compression spring may be provided pushing the lower portion of the structure 320 (that portion below the axis 322) in the forward direction, for example.

Once the trigger 310 is moved rearward by movement 114 from a non-firing position to a firing position and a cartridge is fired, the action of the firearm begins to cycle causing the carrier assembly 130 to move rearward as depicted in FIG. 3C. This moves the engagement feature 132 away from the upper portion 324 of the locking structure 320, allowing the spring or other urging means discussed above but not shown to cause the locking structure 320 to automatically rotate counter-clockwise around axis 322, such that when the trigger 310 is released, a downward facing locking interface 326 on the locking structure 320 automatically engages an upward facing locking interface 311 on a front portion of the trigger 310, and locks the trigger 310 in a rearward position as shown in FIGS. 3C and 3D, thereby restricting movement 114 of the trigger 310 between firing and non-firing positions while the action of the firearm is out-of-battery. This position and state as described with respect to FIG. 3C also includes the static state after a typical semiautomatic firearm has fired the last round of a magazine.

It is understood that any of the triggers contemplated herein, whether triggers 110, 210, 310, or otherwise, may be a trigger assembly comprising various trigger elements, such as a body, a portion that is pulled with a user's finger or otherwise, pivoting or sliding elements, and one or more sear elements that may be fixedly or pivotably connected with the body of the trigger, such as a hammer sear comprising a hammer sear surface, as disclosed throughout various detailed images provided in the applications incorporated herein by reference. It is understood that in a firearm, the sear is the part of the trigger mechanism that holds the hammer, striker, or bolt back until the correct amount of pressure has been applied to the trigger; at which point the hammer, striker, or bolt is released to discharge the weapon. For example and not by way of limitation, in the above example 300, the front portion of the trigger 310 that is engaged by the downward facing locking interface 326 may comprise a sear or sear surface, such as a hammer sear surface, connected with the trigger 310. In other embodiments a sear or sear surface may be located elsewhere on the trigger assembly, such as, for example, a rearward portion of the trigger.

FIG. 3D shows the example embodiment 300 discussed above with respect to FIG. 3C with the carrier assembly 130 returning longitudinally forward in the direction of the arrows and the engagement feature 132 of the carrier assembly 130 re-contacting the upper portion 324 of the locking structure 320 as the action of the firearm continues to cycle after the firing of a cartridge.

FIG. 3E shows the example embodiment 300 discussed above with respect to FIG. 3D with the carrier assembly 130 having fully returned longitudinally forward in the direction of the arrows when the action of the firearm is in an in-battery position ready to fire a second cartridge. The engagement feature 132 of the carrier assembly 130 has pushed forward the upper portion 324 of the locking structure 320, causing the locking structure 320 to rotate clockwise against whatever spring forces may be urging the locking structure in the counter-clockwise direction, and the firearm and its components are in the same positions and states as they were at the beginning of the process as shown and described with respect to FIG. 3A, namely with the trigger 310 automatically unlocked and returned (typically by spring force) to its forward position once the action of the firearm returns to in-battery position. The trigger 310 is then free to move 114 as shown in FIG. 3B. This sequence can be repeated any number of times with any number of cartridges. After firing the last cartridge or round, the present trigger system in a typical semiautomatic rifle may remain in the state shown and described with respect to FIG. 3C. Also, since the trigger 310 is held in the rearward position (e.g., FIGS. 3C, 3D) at least substantially throughout the back-and-forth cycling of the action 130, this tends to reduce the ability of the firearm to be bump-fired by using the momentum of the firearm to repeatedly cycle the trigger 310 between firing and non-firing positions as described in the incorporated the '014 Application.

It is understood that the above-described embodiments are merely illustrative of the application. Other embodiments may be readily devised by those skilled in the art, which may embody one or more aspects or principles of the invention and fall within the scope of the claims. For example, it is contemplated that the present principles could be employed with many other locking mechanisms other than those disclosed as locking structures 120, 220, 320, such as plunger designs, rotating cams, gears, or ratchets, or any other suitable structure that achieves the present purposes. Any suitable materials and manufacturing methods may be used as would be apparent to persons of skill in the art.

What is claimed is:

1. A trigger-locking apparatus for a semi-automatic firearm having a trigger and an action that cycles by a carrier assembly element translating longitudinally and the action loading, firing, and extracting cartridges when the firearm is repeatedly fired by movements of the trigger, the trigger-locking apparatus comprising:

a structure that when in a first position allows movement of the trigger from a rearward pulled position to a forward released position, and when in a second position restricts movement of the trigger from a rearward pulled position to a forward released position;

the trigger-locking apparatus configured so that, when it is installed in the semi-automatic firearm, the structure is configured to:

be held in the first position by contact with the carrier assembly element when the action of the firearm is in an in-battery position ready to fire a first cartridge;

be released from contact with the carrier assembly element and move to the second position when the trigger is pulled to the rearward pulled position and the firearm is firing the first cartridge and the action is being cycled; then be returned to the first position by contact with the carrier assembly element as the action of the firearm cycles back to the in-battery position ready to fire a second cartridge.

2. The trigger-locking apparatus of claim 1, wherein the trigger-locking apparatus is further configured so that, when it is installed in the semi-automatic firearm, the structure is configured to:

be released from contact with the carrier assembly element and move to the second position when the trigger is pulled to the rearward pulled position and the firearm is firing the second cartridge and the action is being cycled; then be returned to the first position by contact with the carrier assembly element as the action of the firearm cycles back to the in-battery position ready to fire a third cartridge.

3. The trigger-locking apparatus of claim 2, wherein the trigger-locking apparatus is further configured so that, when it is installed in the semi-automatic firearm, the structure is configured to:

be released from contact with the carrier assembly element and move to the second position when the trigger is pulled to the rearward pulled position and the firearm is firing a last cartridge and the action is being cycled; then remain released from contact with the carrier assembly element and remain in the second position holding the trigger in the rearward pulled position after the last cartridge is fired and the firearm does not cycle back to the in-battery position.

4. The trigger-locking apparatus of claim 1, wherein the structure is biased toward the second position by a spring.

5. The trigger-locking apparatus of claim 1, wherein the structure is configured to move between the first and second positions by pivoting about an axis.

6. The trigger-locking apparatus of claim 1, wherein the structure is configured to move between the first and second positions by translating linearly.

7. The trigger-locking apparatus of claim 1, wherein the carrier assembly element comprises any of a carrier or a bolt that engages and moves the structure from the first position to the second position when the carrier assembly element translates longitudinally when the action is cycled.

8. The trigger-locking apparatus of claim 1, wherein the carrier assembly element comprises a slide that is configured to translate longitudinally when the action is cycled, and the structure is configured to be moved from the first position to the second position by longitudinal movement of the slide.

9. The trigger-locking apparatus of claim 1, wherein the structure that when in a first position allows movement of the trigger from a rearward pulled position to a forward released position, and when in a second position restricts movement of the trigger from a rearward pulled position to a forward released position, is configured to restrict movement of the trigger from a rearward pulled position to a forward released position by engaging a downward facing surface on a rearward portion of a trigger assembly comprising the trigger.

10. The trigger-locking apparatus of claim 1, wherein the structure that when in a first position allows movement of the trigger from a rearward pulled position to a forward released position, and when in a second position restricts movement of the trigger from a rearward pulled position to a forward released position, is configured to restrict movement of the trigger from a rearward pulled position to a forward released position by engaging an upward facing surface on a forward portion of a trigger assembly comprising the trigger.

11. The trigger-locking apparatus of claim 10, wherein the forward portion of the trigger assembly comprises a hammer sear surface attached with the trigger.

12. A semi-automatic firearm having a trigger, a trigger-locking apparatus, and an action that cycles by a carrier assembly element translating longitudinally and the action loading, firing, and extracting cartridges when the firearm is repeatedly fired by movements of the trigger, the trigger-locking apparatus comprising:

a structure that when in a first position allows movement of the trigger from a rearward pulled position to a forward released position, and when in a second position restricts movement of the trigger from a rearward pulled position to a forward released position;

the trigger-locking apparatus configured so that, when it is installed in the semi-automatic firearm, the structure is configured to:

be held in the first position by contact with the carrier assembly element when the action of the firearm is in an in-battery position ready to fire a first cartridge;

be released from contact with the carrier assembly element and move to the second position when the trigger is pulled to the rearward pulled position and the firearm is firing the first cartridge and the action is being cycled; then be returned to the first position by contact with the carrier assembly element as the action of the firearm cycles back to the in-battery position ready to fire a second cartridge.

13. The semi-automatic firearm of claim 12, wherein the structure is further configured to:

be released from contact with the carrier assembly element and move to the second position when the trigger is pulled to the rearward pulled position and the firearm is firing the second cartridge and the action is being cycled; then be returned to the first position by contact with the carrier assembly element as the action of the firearm cycles back to the in-battery position ready to fire a third cartridge.

14. The semi-automatic firearm of claim 12, wherein the structure is biased toward the second position by a spring.

15. The semi-automatic firearm of claim 12, wherein the structure is configured to move between the first and second positions by pivoting about an axis.

16. The semi-automatic firearm of claim 12, wherein the carrier assembly element comprises a slide that is configured to translate longitudinally when the action is cycled, and the structure is configured to be moved from the first position to the second position by longitudinal movement of the slide.

17. The semi-automatic firearm of claim 12, wherein the structure that when in a first position allows movement of the trigger from a rearward pulled position to a forward released position, and when in a second position restricts movement of the trigger from a rearward pulled position to a forward released position, is configured to restrict movement of the trigger from a rearward pulled position to a forward released position by engaging a downward facing surface on a rearward portion of a trigger assembly comprising the trigger.

18. The semi-automatic firearm of claim 12, The trigger-locking apparatus of claim 1, wherein the structure that when in a first position allows movement of the trigger from a rearward pulled position to a forward released position, and when in a second position restricts movement of the trigger from a rearward pulled position to a forward released position, is configured to restrict movement of the trigger from a rearward pulled position to a forward released position by engaging an upward facing surface on a forward portion of a trigger assembly comprising the trigger.

19. The trigger-locking apparatus of claim 18, wherein the forward portion of the trigger assembly comprises a hammer sear surface attached with the trigger.

20. A method of operating a semi-automatic firearm, comprising the steps of:

providing the semi-automatic firearm of claim 12;

pulling the trigger a first time from the forward released position to the rearward pulled position and firing the first cartridge, thereby causing the action to cycle and the structure to move from the first position into the second position thereby causing the trigger-locking apparatus to lock the trigger in the rearward pulled position, and as the action of the firearm cycles back to the in-battery position ready to fire the second cartridge, causing the structure to move from the second position back to the first position thereby causing the trigger-locking apparatus to unlock the trigger and allowing the trigger to move back to the forward released position;

pulling the trigger a second time from the forward released position to the rearward pulled position and firing the second cartridge, thereby causing the action to cycle and the structure to move from the first position into the second position thereby causing the trigger-locking apparatus to lock the trigger in the rearward pulled position, and as the action of the firearm cycles back to the in-battery position ready to fire a third and last cartridge, causing the structure to move from the second position back to the first position thereby causing the trigger-locking apparatus to unlock the trigger and allowing the trigger to move back to the forward released position; and pulling the trigger a third time from the forward released position to the rearward pulled position and firing the third and last cartridge, thereby causing the action to begin to cycle and the structure to move from the first position into the second position thereby causing the trigger-locking apparatus to:

lock the trigger in the rearward pulled position; and remain released from contact with the carrier assembly element and remain in the second position holding the trigger in the rearward pulled position after the third and last cartridge is fired and the firearm does not cycle back to the in-battery position.

* * * * *